US007029246B2

(12) United States Patent
Miller et al.

(10) Patent No.: US 7,029,246 B2
(45) Date of Patent: Apr. 18, 2006

(54) ROTOR SHAFT BEARING DESIGN AND COUPLING MECHANISM

(75) Inventors: Dale Miller, Cedar Falls, IA (US); Jim Mayer, Cedar Falls, IA (US); Jason Reuther, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 319 days.

(21) Appl. No.: 10/431,197

(22) Filed: May 7, 2003

(65) Prior Publication Data

US 2004/0223864 A1 Nov. 11, 2004

(51) Int. Cl.
*F04B 17/00* (2006.01)

(52) U.S. Cl. ..... 417/420

(58) Field of Classification Search ..... 417/420; 464/29

See application file for complete search history.

(56) References Cited

U.S. PATENT DOCUMENTS 3,238,883 A 3/1966 Martin
4,047,847 A * 9/1977 Oikawa ..... 417/370
4,065,235 A * 12/1977 Furlong et al. ..... 417/420
4,111,614 A 9/1978 Martin et al.
4,613,289 A * 9/1986 Kotera ..... 417/420
4,871,301 A * 10/1989 Buse ..... 417/420
6,722,854 B1 * 4/2004 Forsberg ..... 417/63

FOREIGN PATENT DOCUMENTS

EP 1 096 149 A2 5/2001

OTHER PUBLICATIONS

European Search Report for EP 04101988.6 dated Aug. 9, 2004.

* cited by examiner

*Primary Examiner*—Charles G. Freay
(74) *Attorney, Agent, or Firm*—Miller, Matthias & Hull

(57) ABSTRACT

An improved magnetic drive pump is disclosed with improved bearing support for the proximal and distal ends of the rotor shaft. Further, an improved mechanism to couple the inner magnet assembly to the rotor shaft is also disclosed. Finally a mechanism for sealing the pump chamber from the interior of the canister that surrounds the inner magnet assembly is disclosed which permits a separate supply of coolant to be used for cooling the inner magnet assembly and the proximal end of the rotor shaft wherein such a coolant is not the fluid being pumped in the pump chamber. The pump chamber is isolated from the interior of the canister.

26 Claims, 6 Drawing Sheets

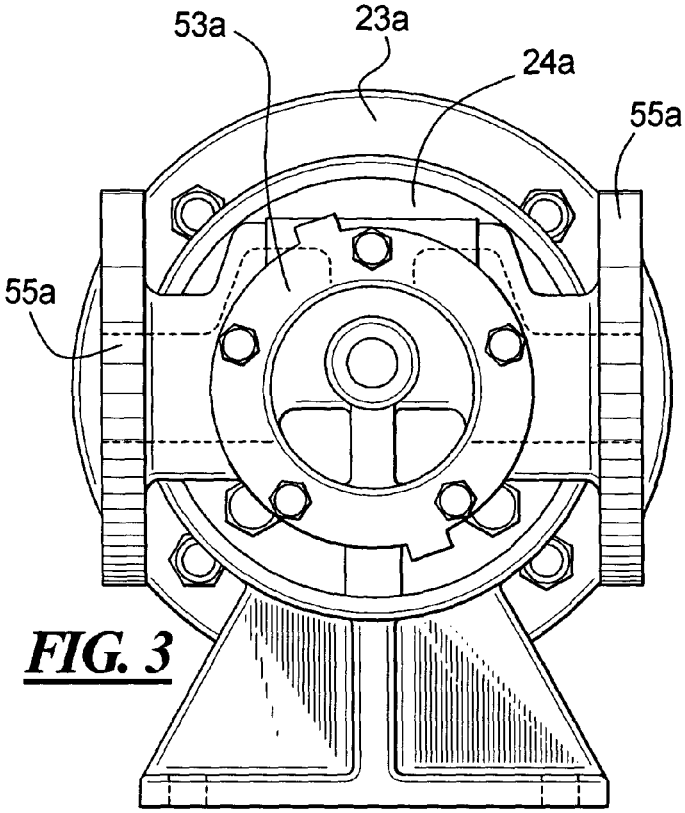
FIG. 3
FIG. 6
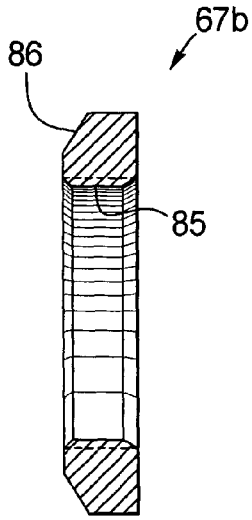
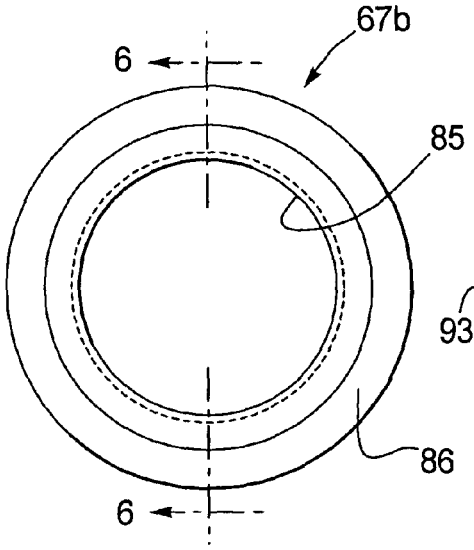
FIG. 5
FIG. 9
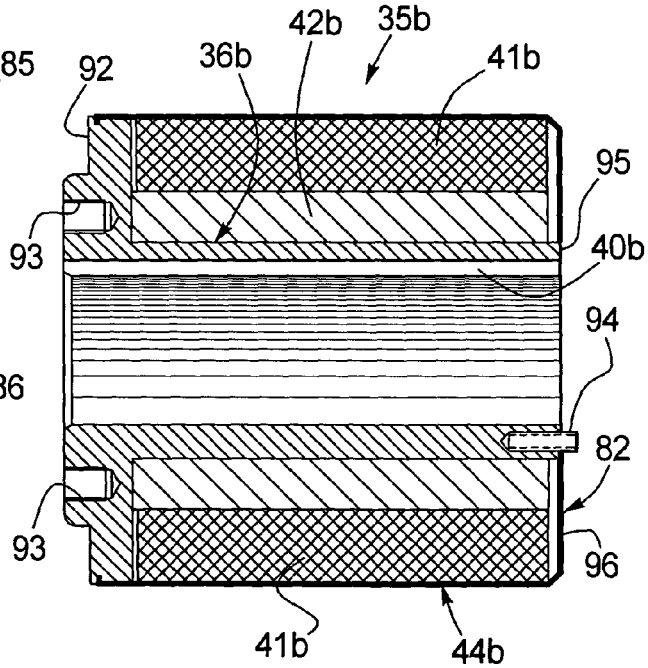

ROTOR SHAFT BEARING DESIGN AND COUPLING MECHANISM

TECHNICAL FIELD

An improved magnetic drive pump is disclosed. More specifically, a magnetic drive pump is disclosed wherein bearing support for the rotor shaft is provided within the canister that houses the inner magnet assembly. Further, bearing support is also provided for the rotor shaft adjacent the rotor. Thus, bearing support is provided for the rotor shaft at a proximal end of the rotor shaft disposed within the canister and at a distal end of the rotor shaft disposed adjacent the rotor. Further, a mechanism for providing a seal to inhibit fluid migration from the pump chamber to this canister is also provided which permits a separate coolant fluid to be circulated within the canister in the event it is undesirable to use the fluid being pumped as a coolant fluid for the canister. Still further, an improved coupling mechanism for connecting the rotor shaft to the inner magnet assembly of a magnetic drive pump is also disclosed.

BACKGROUND

Magnetic drive pumps have been employed which eliminate the need for the drive shaft to pass through the exterior of the pump enclosure to the pump chamber. In a magnetic drive pump, two shafts including a drive shaft and a rotor shaft, are utilized as opposed to a single drive shaft.

An example of a conventional magnetic drive pump 20 is illustrated in FIG. 1. A drive shaft 21 passes through a barring carrier assembly 22 which is connected to coupling bracket 23 which, in turn, is connected to the casing 24. The proximal end 25 of the drive shaft 21 is coupled to the motor or driver (not shown) often by a keyed or key-type coupling. A slot or groove in the proximal end 25 of the drive shaft 21 is shown at 26 for this purpose. The drive shaft passes through a bearing assembly 27 which provides bearing support for the shaft 21. The distal end 30 of the drive shaft is connected to an outer magnet assembly 28 which includes a proximal end 29 that is fixed to the drive shaft 21 by one or more fasteners, such as the set screw shown at 31. A distal cylindrical section 32 of the outer magnet assembly 28 forms a cup that extends axially beyond the distal end 30 of the drive shaft 21 and includes an. inner surface 33 that is connected to a plurality of outer magnets 34.

The outer magnet assembly 28 surrounds an inner magnet assembly 35. The inner magnet assembly 35 includes an annular sleeve 36 that is connected to a rotor shaft 37, often by a key-type connection illustrated by the groove 38 disposed towards the proximal end 39 of the rotor shaft 37 and the key 40 disposed on the inner cylindrical wall of the sleeve 36 of the inner magnet assembly 35. The annular sleeve 36 is connected to a plurality of inner magnets 41 disposed between and connected to potting compound shown at 42. The inner magnet assembly 35 also includes a cover 43 and the entire assembly is disposed within a canister 44 (or "can") that is connected to the coupling bracket 23 and casing 24 by way of the annular flange 45 being sandwiched between the casing 24 and coupling bracket 23 which, as noted above, are connected together.

In the conventional design shown in FIG. 1, the proximal end 39 of the rotor shaft 37 is connected to a spacer or washer 46 which is also disposed within the sleeve 36 of the inner magnet assembly 35. No bearing support is provided for the proximal end 39 of the rotor shaft 37. Instead, the rotor shaft 37 passes through one or more bushings 47 disposed between the proximal end 39 and the distal end 48 of the rotor shaft 37.

The distal end 48 of the rotor shaft then is conventionally connected to a rotor 49 which is enmeshed with an idler 51 that is connected to an idler shaft or pin 52 which, in turn, is connected to the head 53. The head 53 in combination with the casing 24 defines a pump chamber in which the rotor 49 and idler 51 are disposed. A crescent 54 is connected to the head 53.

In designs similar to that shown in FIG. 1, the axial position of the rotor shaft 37 within the casing 24 may be less stable than desired resulting in the possibility of axial forces being imposed on the rotor 49 and idler 51, in the pump chamber. Further, the lack of bearing support at either the proximal end 39 or the distal end 48 of the rotor shaft 37 may be problematic in some designs resulting in the proximal end 39 and the distal end 48 of the shaft 37 being exposed to excessive frictional forces thereby requiring more frequent maintenance.

Still another problem associated with the design shown in FIG. 1 is the use of the pumped fluid as a coolant for the components disposed within the canister 44. Specifically, input or output ports of the pump chamber are shown in phantom at 55. The rotor shaft 37 is hollow and includes an axial passageway shown in phantom at 56. In addition to being pumped between the input and output ports 55, fluid also migrates from the pump chamber, through the distal end 49 or the rotor shaft 37 and down the axial passageway 56 of the rotor shaft 37 to the canister 44 thereby providing fluid to the canister 44 which serves as a coolant. Further, if the fluid being pumped is extremely abrasive, such as a metal particulate slurry, damage to the inner magnet assembly 35 may occur as the canister 44 or cover 43 may receive undue wear from the abrasive liquid. Finally, some liquids are not suitable for use as a coolant medium for the inner magnet assembly 35. Specifically, if the liquid being pumped is at a elevated temperature and is subject to a liquid-to-solid phase change at a lower temperature, such a liquid would not be suitable as a coolant for the inner magnet assembly 35 because it may be prone to a liquid-to-solid phase change within the inner magnet assembly 35 which, of course, would inhibit or block flow through the inner magnet assembly 35 and require more frequent maintenance.

Thus, there is a need for an improved design which provides improved bearing support and axial stability for the rotor shaft 37. Also, there is a need for an improved system for cooling the components contained within the canister 44 which include the inner magnet assembly 35 and proximal end 39 of the rotor shaft 37.

SUMMARY OF THE DISCLOSURE

An improved magnetic drive pump is disclosed which comprises a rotor shaft having a proximal end mateably received within a proximal bushing and a distal end connected to a rotor. The rotor shaft passes through and is connected to an inner magnet assembly disposed between the proximal bushing and the rotor. The rotor shaft further passes through a distal bushing disposed between the inner magnet assembly and the rotor. The proximal bushing is received and supported within a proximal end of a canister that encloses the inner magnet assembly.

In a refinement, the rotor shaft also passes through two thrust washers that are disposed immediately on opposing ends of the distal bushing or which sandwich the distal bushing. In a further refinement of this concept, the rotor shaft passes through a proximal thrust washer sandwiched between a distal end of the inner magnet assembly and the distal bushing and the rotor shaft also passes through a distal thrust washer sandwiched between the distal bushing and the rotor.

In another refinement, the proximal end of the canister comprises a cup that encloses the proximal bushing and the proximal end of the rotor shaft. The proximal end of the canister is connected to a radial section that extends radially outwardly from the proximal end of the canister. The radial section of the canister is connected to an axial section of the canister that comprises a cylinder that extends coaxially around the inner magnet assembly and terminates at an open distal end that is connected to a casing. The casing includes an axial passage in which the distal bushing is mateably received. The casing further defines a pump chamber in which the rotor and distal end of the rotor shaft are received. The axial passage of the casing extends from the open distal end of the canister to the pump chamber.

In another refinement of the above concept, the distal bushing, the rotor shaft, the distal thrust washer and the rotor provide a seal which inhibits fluid migration from the pump chamber in a proximal direction towards the axial passage of the casing. If such a refinement is employed, the casing can be further equipped with an inlet passageway and an outlet passageway providing communication to the interior of the canister and a separate coolant fluid may be pumped through the canister.

In a similar refinement, the distal bushing, the rotor shaft, the proximal thrust washer and the inner magnet assembly provide a seal which inhibits such a fluid migration from the canister in a distal direction towards the axial passage of the casing to prevent coolant circulated through the casing from migrating towards the pump chamber.

An improved mechanism for connecting the inner magnet assembly to the rotor shaft is also disclosed which enhances the stability of the axial position of the rotor shaft. More specifically, the rotor shaft is equipped with a threaded surface disposed between a proximal end of the inner magnet assembly and the proximal bushing. The threaded surface of the rotor shaft is threadably connected to an annular locknut. The annular locknut comprises an annular bearing surface facing in a proximal direction, or towards the proximal end of the rotor shaft. The bearing surface of the annular lock nut abuttingly engages a lock ring. The lock ring is connected to the proximal end of the inner magnet assembly by at least one fastener with a lock nut sandwiched between the proximal end of the inner magnet assembly and the lock ring. The inner magnet assembly further comprises an axial key which is accommodated in an axial groove disposed in an outer surface of the rotor shaft and distally of the threaded surface of the rotor shaft.

In a further refinement of this concept, the annular bearing surface of the lock nut is frusto-conically shaped and the lock ring further comprises a beveled annular bearing surface that mateably receives the frusto-conically shaped bearing surface of the lock nut.

The above-coupling mechanism can be employed separate and apart from the use of the proximal and distal bushings for supporting the rotor shaft described above. In other words, the above-described coupling mechanism can be employed in a conventional magnetic drive pump design, e.g., the pump of FIG. 1 without a proximal bushing for the rotor shaft or the sealing mechanism that includes the aforenoted thrust washers disposed on opposing ends of the rotor shaft bushing.

BRIEF DESCRIPTION OF THE DRAWINGS

The disclosed embodiments are described more or less diagrammatically in the accompanied drawings, wherein:

FIG. 3 is an end view of the magnetic drive pump shown in FIG. 2;

FIG. 5 is a front plan view of a lock nut of an improved coupling mechanism for coupling the inner magnet assembly to the rotor shaft and which further improves the stability of the axial position of the rotor shaft of a magnetic drive pump in accordance with this disclosure;

FIG. 6 is a sectional view taken along the line 6—6 of FIG. 5;

FIG. 9 is a sectional view of an inner magnet assembly of the improved magnetic drive pump shown in FIG. 4 and which can be used with the lock ring disclosed in FIGS. 5 and 6 and the lock nut disclosed in FIGS. 7 and 8;

It should be understood that the drawings are not necessarily the scale and that the embodiments may be illustrated by graphic symbols, phantom lines, diagrammatic representations and fragmentary views. In certain instances, details which are not necessary for an understanding of the disclosed improvements or which render other details difficult to perceive may have been omitted. It should be understood, of course, that the broad concepts of this disclosure are not limited to the particular embodiments illustrated herein.

DETAILED DESCRIPTION OF THE PRESENTLY PREFERRED EMBODIMENTS

Figure 1:
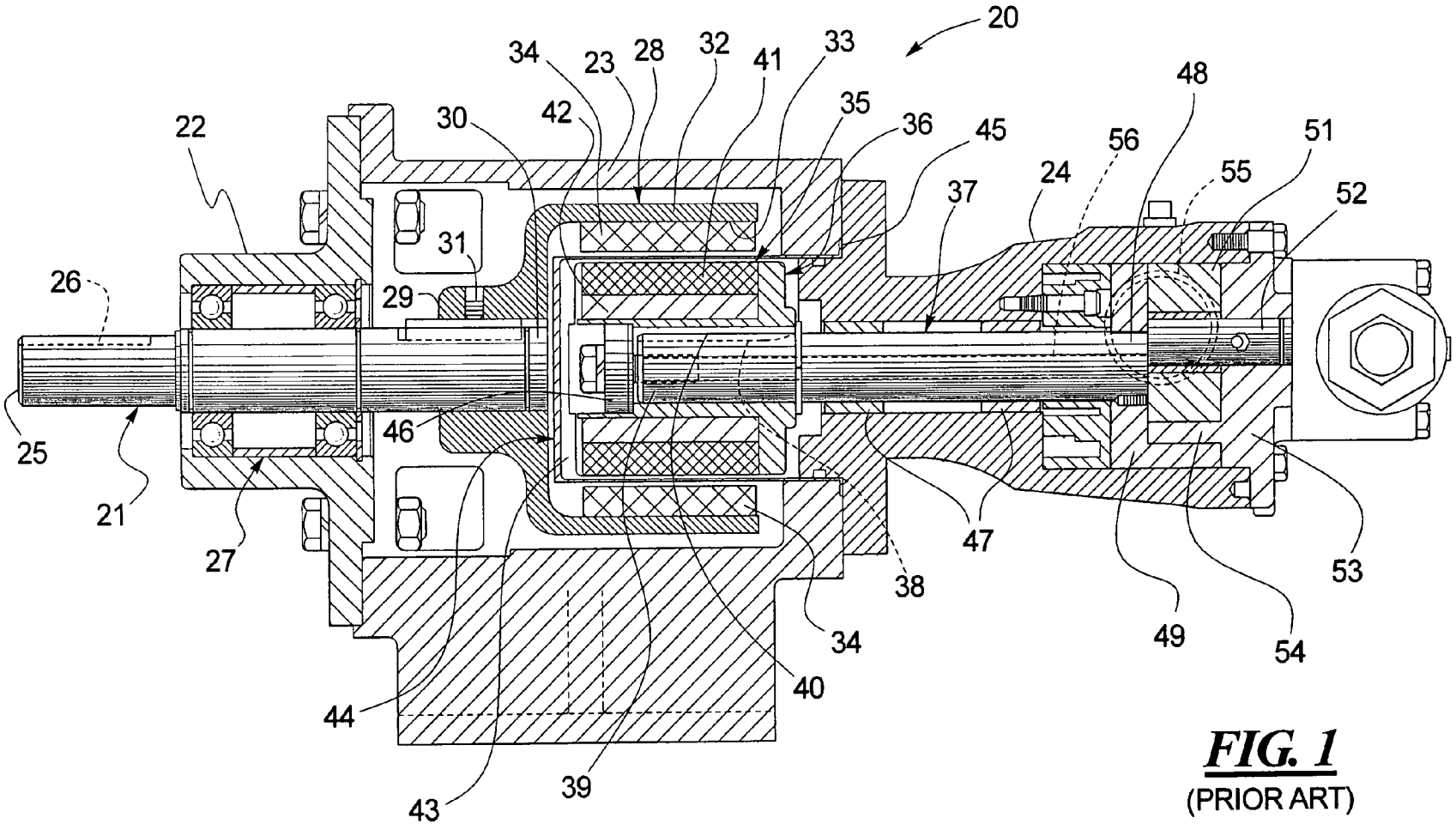
FIG. 1 (PRIOR ART)
FIG. 1 is a section view of a magnetic drive pump made in accordance with the prior art.
Figure 2:
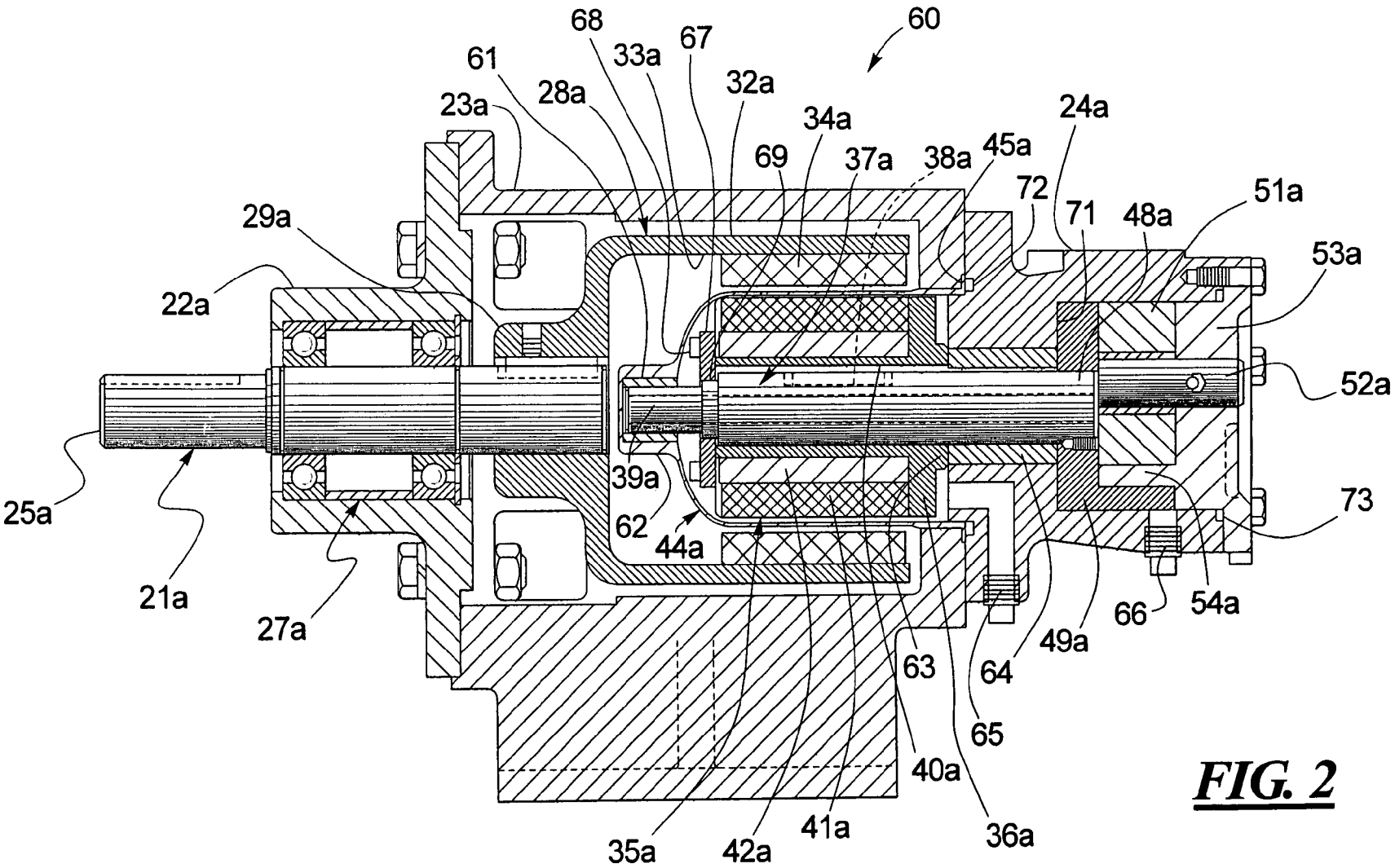
FIG. 2 is a sectional view of an improved magnetic drive pump design in accordance with this disclosure.

Turning to FIG. 2, one disclosed embodiment of a magnetic drive pump 60 will now be described and reference numerals for like or similar components to those described above with respect to the pump 20 of FIG. 1 will be utilized with the suffix "a".

The pump 60 of FIG. 2 include a drive shaft of 21*a* that is supported by a bearing carrier assembly 22*a* that includes a bearing assembly 27*a*. The bearing carrier assembly 22*a* is connected to a coupling bracket 23*a* which, in turn, is connected to a casing 24*a*. The drive shaft 21*a* includes a proximal and end 25*a* coupled to a motor and a distal end 27*a* which is coupled to a proximal end 29*a* of an outer magnet assembly 28*a*. The distal cylindrical section 32*a* of the outer magnet assembly 28*a* includes an inner surface 33*a* that is connected to a plurality of outer magnets shown at 41*a*. The outer magnet assembly 28*a* surrounds a canister 44*a* that houses an inner magnet assembly 35*a* and a proximal end 39*a* of a rotor shaft 37*a*. The proximal end 39*a* of the rotor shaft of 37*a* is supported by a proximal bushing 61 disposed within a proximal end 62 of the canister 44*a*. The proximal end 62 of the canister 44*a* forms a cup which accommodates the proximal bushings 61 and the proximal end 39*a* of the rotor shaft 37*a*. The canister then is sealingly connected to the coupling bracket 23*a* and casing 24*a* by way of its distal annular flange 45*a* in a manner similar to that shown in FIG. 1.

In addition to the proximal bushing 61, a distal bushing 64 is also provided to support the distal end 48*a* of the rotor shaft 37*a*. The distal bushing 64 is disposed in an axial passage in the casing 24*a* disposed between the rotor 49*a* and distal end of the inner magnet assembly 35*a*, or between the annular flange 63 of the sleeve 36*a* that supports the inner magnets 41*a* and potting material 42*a*. Thus, by way of the proximal bushing 61 and distal bushing 64, both the proximal end 39*a* and distal end 48*a* of the rotor shaft 37*a* receive bearing support.

Drain ports for the canister 44*a* and the pump chamber are shown at 65, 66 respectively. The inner magnet assembly 35*a* is connected to the rotor shaft 37*a* by way of the lock nut shown at 67 and fasteners shown at 68. Specifically, the rotor shaft 37*a* includes a stepped threaded surface 69 to which the lock nut is threadably connected. As shown in FIG. 2, the diameter of the threaded surface 69 is greater than the diameter of the proximal end 39*a* of the rotor shaft 37*a* is less than the diameter of the distal end 48*a* of the rotor shaft 37*a*. Thus, the lock nut 67 can be securely threadably attached to the rotor shaft 37*a* at the threaded surface 69. Then, one or more fasteners can be used to secure the inner magnet assembly 35*a* axially to the rotor shaft 37*a*. In addition, to secure the radial position of the inner magnet assembly 35*a* to the rotor shaft 37*a*, a keyed connection can be utilized whereby a key 40*a* on an inner radial surface of the sleeve 36*a* is accommodated in an axial groove 38*a* disposed in a rotor shaft 37*a*.

In the embodiment 60 shown in FIG. 2, the axial position of the rotor shaft 37*a* is stabilized because the lock nut 67 is securely fastened to the inner magnet assembly 35*a* and axial movement of the inner magnet assembly 35*a* in a distal direction or towards the pump chamber is prevented by engagement of the annular flange 63 against the distal bushing 64. Further, axial movement of the rotor shaft 37*a* in a proximal direction, or towards the proximal end 62 of the can 44*a* is prevented by engagement of the rotor 49*a* against the distal bushing 64 or against the proximal wall 71 of the pump chamber that is defined by the casing 24*a* and head 53*a*.

Referring to FIG. 3 inlet and outlet ports are shown at 55*a*. Returning to FIG. 2, an o-ring for sealing the connection between the casing 24*a* and the coupling bracket 23*a* is shown at 72 while an o-ring for sealing the connection between the casing 24*a* and the head 53*a* is shown at 73.

Figure 4:
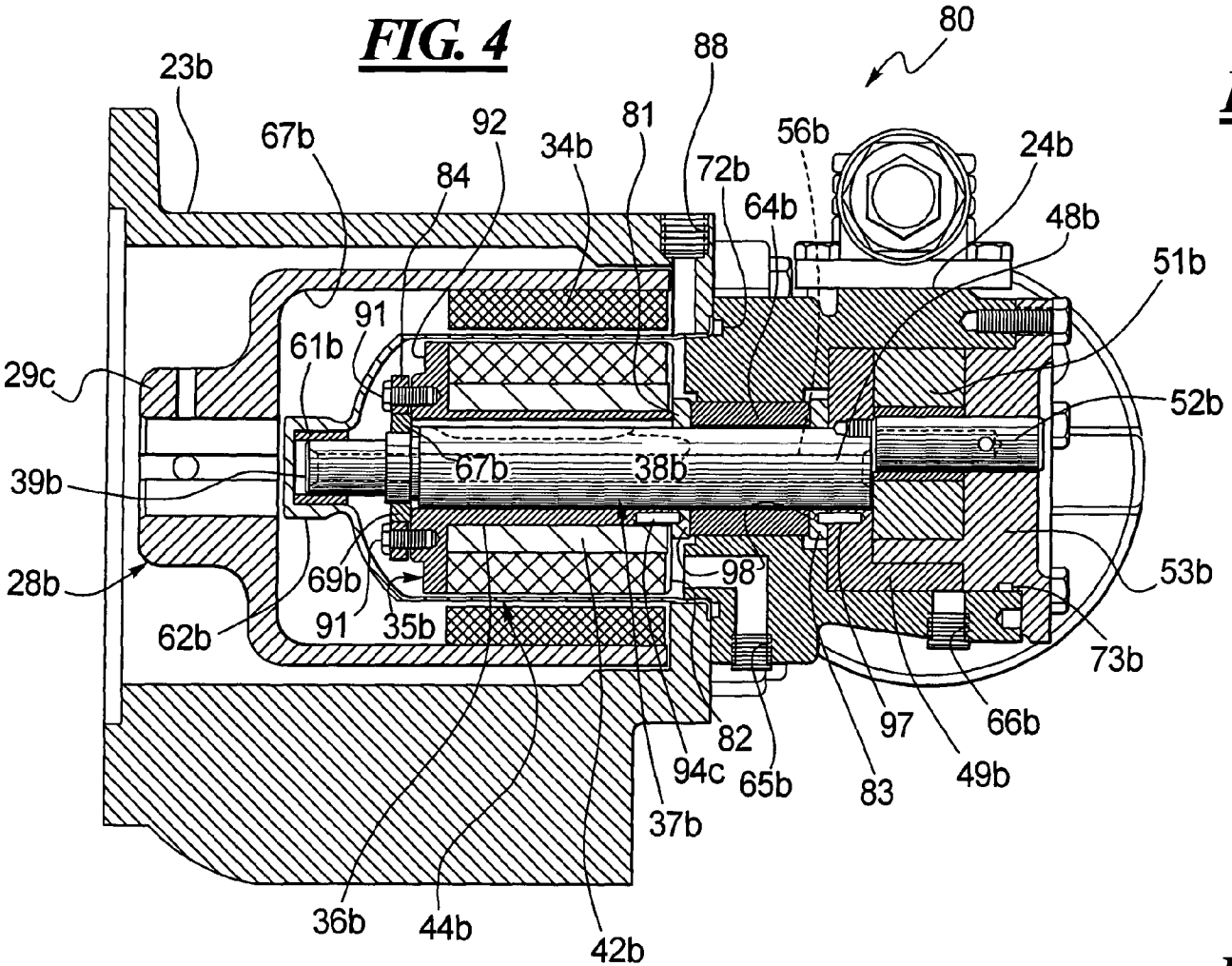
FIG. 4 is a sectional view of yet another improved magnetic drive pump made in accordance with this disclosure.
Figure 10:
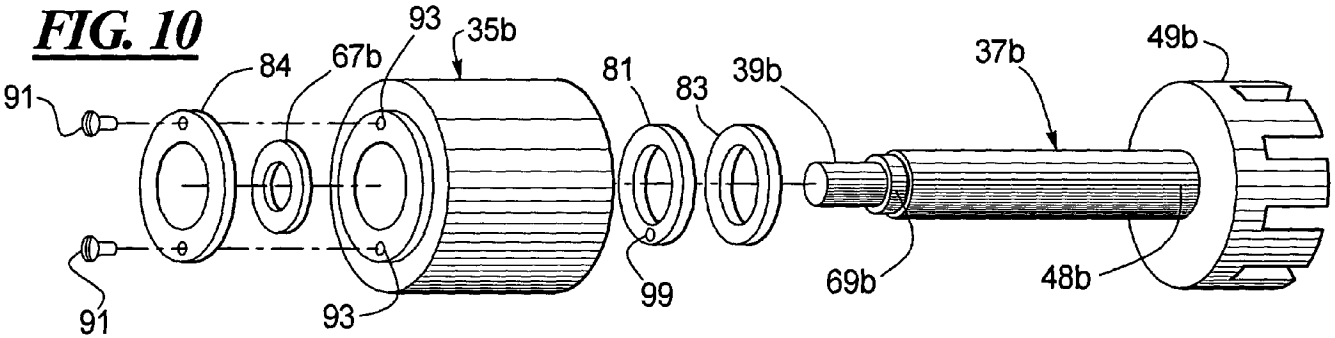
FIG. 10 is an exploded view of the rotor shaft, rotor, proximal and distal thrust washers, inner magnet assembly, lock ring and lock nut disclosed in FIGS. 4-9.

Turning to FIG. 4, another embodiment of a magnetic drive pump 80 is illustrated. Components of the pump 80 that are similar or analogous to components described above for the pump 20 of FIG. 1 or the pump 60 of FIG. 2 will be referenced with like reference numerals but using the suffix "b." A primary difference is between the pump 80 of FIG. 4 and the pump 60 of FIG. 2 relates to the use of a proximal thrust washer 81 disposed between the distal bushing 64*b* and the distal end 82 of the inner magnet assembly 35*a* as well as the distal thrust washer 83 disposed between the distal bushing 64*b* and the rotor 49*b*. The proximal and distal thrust washers 81, 83 enhance the axial stability of the rotor shaft 37*b* and inner magnet assembly 35*a* by providing resistance to friction forces in either the proximal axial direction or distal axial direction.

The pump 80 shown in FIG. 4 also discloses a modification to the manner in which the inner magnet assembly 35*b* is connected to the rotor shaft 37*b* and the structure of the inner magnet assembly 35*b* itself. These further modifications are illustrated in FIGS. 5–9 as well as FIG. 4.

Specifically, referring to FIGS. 4–6, it will noted that the rotor shaft 37*b* includes a stepped threaded surface 69*b* similar to that shown at 69 in FIG. 2. Instead of a single lock nut 67 as shown in FIG. 2, the threaded surface 69*b* is threadably coupled to a shaped lock nut 67*b* which, in turn, abuttingly engages a complimentary-shaped lock ring 84. A lock nut 67*b* and lock ring 84 are further illustrated in FIGS. 5–6 and 7–8 respectively.

Referring to FIGS. 5–6, the lock nut 67*b* includes a threaded inner surface 85 which enables the lock nut 67*b* to be secured on the threaded surface 69*b* of the stepped portion of the rotor shaft 37*b* which, as described above, has a diameter greater than the proximal end 39*b* of the rotor shaft 37*b* but smaller than the diameter of the distal end 48*b* of the rotor shaft 37*b*. In FIG. 6 it will be noted that the proximally facing surface of the lock nut 67*b* includes a frusto-conical surface 86 for engaging the lock ring 84 shown in FIGS. 7–8.

Figure 7:
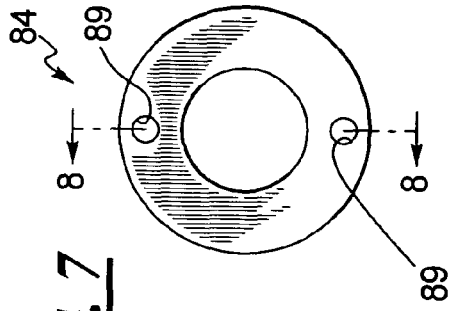
FIG. 7 is a front plan view of a lock ring of the improved mechanism for coupling the inner magnet assembly to the rotor shaft and for improving the stability of the axial position of the rotor shaft of a magnetic drive pump in accordance with this disclosure.
Figure 8:
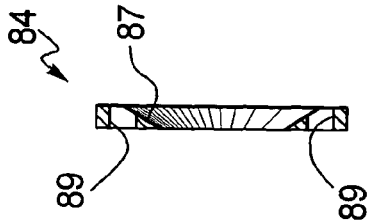
FIG. 8 is a sectional view taken along line 8—8 of FIG. 7.

Turning to FIG. 7–8, the lock ring 84 includes a beveled distally-facing surface 87 for mateably receiving the frusto-conically shaped surface 86 of the lock nut 67*b*. Apertures are whole are shown at 89 for receiving the fasteners shown at 91 in FIG. 4 which secure the lock ring 84 to the inner magnet assembly 35*b* with the lock nut 67*b* sandwiched therebetween. Thus, the threaded connection between the lock nut 67*b* and the rotor shaft 37*b* secures the axial position of the lock nut 67*b* with respect to the rotor shaft 37*b*. Then, using the lock nut 67*b* as an anchor, the lock ring 84 is fastened to the proximal end 92 of the inner magnet assembly 35*b* thereby stabilizing the axial position of the inner magnet assembly 35*b*. Further stabilization to the axial position of the inner magnet assembly 35*b* and rotor shaft 37*b* are provided by the thrust washers 81, 83 as described above.

Turning to FIG. 9, the proximal end 92 of the sleeve 36*b* of the inner magnet assembly 35*b* includes a pair of threaded apertures 93 for threadable connection to the fasteners shown at 91 in FIG. 4. The sleeve 36*b* does not include a distal end with an abutting flange like that shown at 63 in FIG. 2. Instead, the proximal thrust washer 81 is used in its place. The inner magnet assembly 35*b* also includes the plurality of inner magnets shown at 41*b* disposed between potting material shown at 42*b*. A pin shown at 94 may be used secure the thrust washer 81 (FIG. 4) to the distal end 95 of the inner magnet assembly 35*b*. Similarly, a pin 97 may be used to secure the distal thrust washer 83 to the rotor 49*b*. Protecting the inner magnet assembly 35*b* is a cover 44*b* which extends from the distal end 92 of the inner magnet assembly 35*b* in a cylindrical manner before terminating at a distal annular flange shown at 96.

Briefly turning to FIGS. 10–13, it will be noted that the rotor shaft 37*b* can be integrally connected to the rotor 49*b*. The distal end 48*b* of the rotor shaft 37*b* has a diameter that exceeds the threaded portion 69*b* which, in turn, has a diameter that exceeds the diameter of the proximal end 39*b* of the rotor shaft 37*b*. The thrust washers 81 and 83 and it will be noted that the proximal thrust washer 81 may include an aperture 99 for accommodating the pin 95 which links the distal end 82 of the inner magnet assembly 35*b* to the proximal thrust washer 81.

Figure 11:
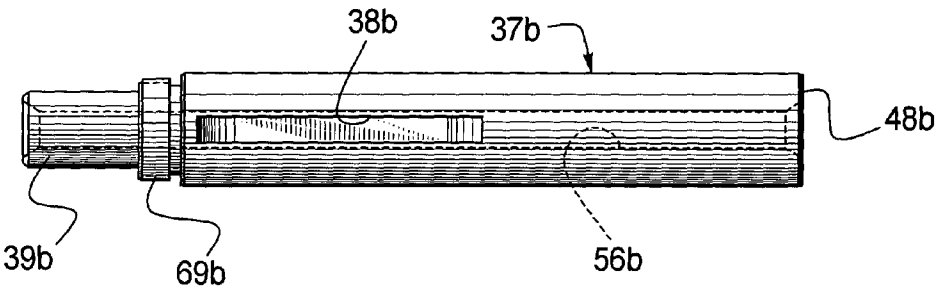
FIG. 11 is a top plan view of the rotor shaft disclosed in FIG. 4.
Figure 12:
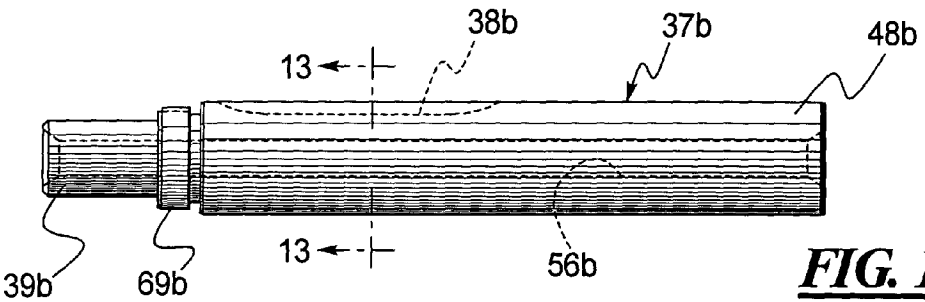
FIG. 12 is a front plan view of the rotor shaft shown in FIG. 11.
Figure 13:
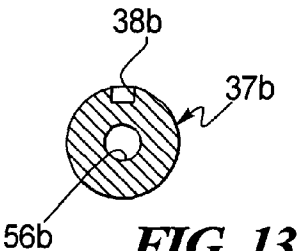
FIG. 13 is a sectional view taken substantially along line 13—13 of FIG. 12.

Turning to FIGS. 11–13, the rotor shaft 37*b* includes an axial passageway 56*b* that, as described above with respect to FIG. 1 can provide communication between the pump chamber and the interior of the can 44*b*. The rotor shaft 37*b* is also equipped with a slot or groove 38*b* for the tongue-in-groove coupling between the rotor shaft and 37*b* and the inner magnet assembly 35*b*.

Figure 14:
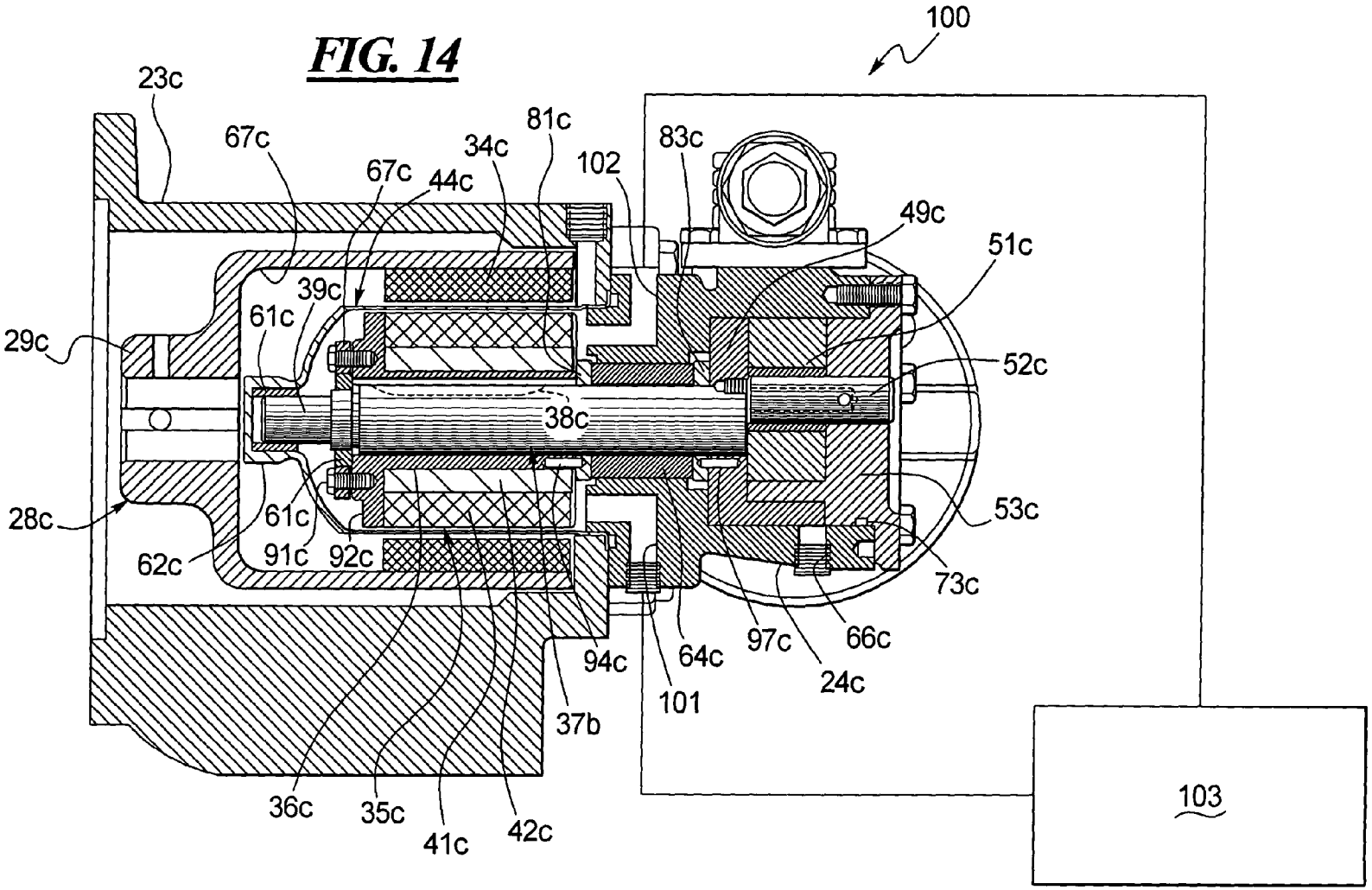
FIG. 14 is yet another embodiment of an improved magnetic drive pump in accordance with this disclosure.

Turning to FIG. 14, another embodiment 100 is disclosed which differs from the embodiment in FIG. 4. Specifically, referring back to FIG. 4, the proximal and distal ends of the distal bushing 64*b* includes radial slot shown at 98 that permits the entry of fluid between the distal bushing 64*b* and the thrust washers 81, 83. However, as shown in FIG. 14, the slots 98 in FIG. 4 have been eliminated so that a seal is provided between the distal bushing 64*c*, distal thrust washer 83*c* and proximal thrust washer 81*c*. Providing a seal on either side of the distal bushing 64*c* enables the pump chamber to be isolated from the axial passage through the casing in which the distal bushing 64*c* is accommodated. Further, the axial passageway 56*b* through the rotor shaft 37*b* has been eliminated.

Thus, instead of using the fluid being pumped through the pump chamber defined by the casing 24*c* and head 53*c* as a coolant medium for the interior of the can 44*c*, separate inlet and outlet ports are shown at 101, 102 which provide communication to the interior of the can 44*c* or the chamber defined by the can 44*c* and the casing 24*c*. Thus, a separate coolant medium may be used to cool the inner magnet assembly 35*c* and proximal end 39*c* of the rotor shaft 37*b*. The design of the embodiment 100 shown in FIG. 14 may be particularly suitable when the pump 100 is used to pump abrasive fluids or liquids prone to solidification during the pumping operation. Thus, the ports 101, 102 can be connected to a supply of coolant 103 for purposes of circulating coolant through the interior of the can 44*c*. The remaining components of the pump 100 as shown in FIG. 4 are the same as those illustrated in FIGS. 4 and/or 2 and therefore will not be repeated here.

While only certain embodiments have been set forth, alternative embodiments and various modifications will be apparent from the above-description to those skilled in the art. These and other alternatives are considered equivalents and within the spirit and scope of this disclosure.

What is claimed is:

1. A magnetic drive pump comprising:

a rotor shaft comprising a proximal end mateably and frictionally received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the proximal bushing being received and supported within a proximal end of a canister that encloses the inner magnet assembly, wherein proximal end of the canister comprises a cup that encloses the proximal bushing and the proximal end of the rotor shaft, the proximal end of the canister being connected to a radial section that extends radially outwardly from the proximal end of the canister, the radial section of the canister being connected to an axial section of the canister that comprises a cylinder that extends axially around the inner magnet assembly and terminates at an open distal end that is connected to a casing, the casing comprising an axial passage in which the distal bushing is mateably received, the casing further defining a pump chamber in which the rotor and distal end of the rotor shaft are received, the axial passage of the casing extending from the open distal end of the canister to the pump chamber, wherein the rotor shaft also passes through two annular thrust washers that sandwich the distal bushing.

2. The magnetic drive pump of claim 1 wherein the distal bushing, rotor shaft, distal thrust washer and rotor providing a seal and preventing fluid migration from the pump chamber in a proximal direction towards the axial passage of the casing.

3. The magnetic drive pump of claim 2 wherein the casing comprises an inlet passageway connected to a supply of coolant, the inlet passageway extending through the casing to a point disposed radially inside of the open distal end of the canister to connect an interior of the canister to the supply of coolant, the casing further comprising an outlet passageway connecting the interior of the canister to the supply of coolant.

4. The magnetic drive pump of claim 1 wherein the rotor shaft comprises a threaded surface disposed between a proximal end of the inner magnet assembly and the proximal bushing, the threaded surface of the rotor shaft being threadably connected to an annular locknut, the annular locknut comprising an annular bearing surface facing in a proximal direction towards the proximal end of the rotor shaft, the bearing surface of the annular locknut engaging a lock ring, the lock ring being connected to the proximal end of the inner magnet assembly by at least one fastener with the annular locknut sandwiched therebetween, the inner magnet assembly further comprising an axial key that is accommodated in an axial groove disposed in an outer surface of the rotor shaft disposed distally of the threaded surface of the rotor shaft.

5. The magnetic drive pump of claim 4 wherein the annular bearing surface of the lock nut is frusto-conically shaped and the lock ring further comprises a beveled annular bearing surface the mateably receives the frusto- conically shaped bearing surface of the lock nut.

6. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the proximal bushing being received and supported within a proximal end of a canister that encloses the inner magnet assembly, the rotor shaft further comprising a threaded surface disposed between a proximal end of the inner magnet assembly and the proximal bushing, the threaded surface of the rotor shaft being threadably connected to an annular locknut, the annular locknut comprising an annular bearing surface facing in a proximal direction towards the proximal end of the rotor shaft, the bearing surface of the annular locknut engaging a lock ring, the lock ring being connected to the proximal end of the inner magnet assembly by at least one fastener with the annular locknut sandwiched therebetween, the inner magnet assembly further comprising an axial key that is accommodated in an axial groove disposed in an outer surface of the rotor shaft disposed distally of the threaded surface of the rotor shaft.

7. The magnetic drive pump of claim 6 wherein the rotor shaft also passes through two annular thrust washers that sandwich the distal bushing.

8. The magnetic drive pump of claim 6 wherein the rotor shaft also passes through a proximal thrust washer sandwiched between a distal end of the inner magnet assembly and the distal bushing and the rotor shaft also passes through a distal thrust washer sandwiched between the distal bushing and the rotor.

9. The magnetic drive pump of claim 6 wherein the proximal end of the canister comprises a cup that encloses the proximal bushing and the proximal end of the rotor shaft, the proximal end of the canister being connected to a radial section that extends radially outwardly from the proximal end of the canister, the radial section of the canister being connected to an axial section of the canister that comprises a cylinder that extends axially around the inner magnet assembly and terminates at an open distal end that is connected to a casing, the casing defining an axial passage in which the distal bushing is mateably received, the casing further defining a pump chamber in which the rotor and distal end of the rotor shaft are received, the axial passage of the casing extending from the open distal end of the canister to the pump chamber.

10. The magnetic drive pump of claim 9 wherein the rotor shaft also passes through a proximal thrust washer sandwiched between a distal end of the inner magnet assembly and the distal bushing and the rotor shaft also passes through a distal thrust washer sandwiched between the distal bushing and the rotor, the distal bushing, rotor shaft, distal thrust washer and rotor providing a seal and inhibiting fluid migration from the pump chamber in a proximal direction to the axial passage of the casing.

11. The magnetic drive pump of claim 10 wherein the casing comprises an inlet passageway connected to a supply of coolant, the inlet passageway extending through the casing to a point disposed radially inside of the open distal end of the canister to connect an interior of the canister to the supply of coolant, the casing further comprising an outlet passageway connecting the interior of the canister to the supply of coolant.

12. The magnetic drive pump of claim 9 wherein the rotor shaft also passes through a proximal thrust washer sandwiched between a distal end of the inner magnet assembly and the distal bushing and the rotor shaft also passes through a distal thrust washer sandwiched between the distal bushing and the rotor, the distal bushing, rotor shaft, proximal thrust washer and inner magnet assembly providing a seal and inhibiting fluid migration from canister in a distal direction to the axial passage of the casing.

13. The magnetic drive pump of claim 12 wherein the casing comprises an inlet passageway connected to a supply of coolant, the inlet passageway extending through the casing to a point disposed radially inside of the open distal end of the canister to connect an interior of the canister to the supply of coolant, the casing further comprising an outlet passageway connecting the interior of the canister to the supply of coolant.

14. The magnetic drive pump of claim 6 wherein the annular bearing surface of the lock nut is frusto-conically shaped and the lock ring further comprises a beveled annular bearing surface the mateably receives the frusto-conically shaped bearing surface of the lock nut.

15. A coupling mechanism for connecting an inner magnet assembly to a rotor shaft of a magnetic drive pump, the mechanism comprising:

a rotor shaft comprising a threaded surface, an inner magnet assembly mounted to the rotor shaft distally of the threaded surface by an axial key in groove connection, the inner magnet assembly comprising a proximal end, a lock nut threadably connected to the rotor shaft at the threaded surface thereof, the lock nut comprising an annular bearing surface facing away from the inner magnet assembly, a lock ring comprising a bearing surface abuttingly engaging the bearing surface of the lock nut, the lock ring being connected to the proximal end of the inner magnet assembly by at least on fastener to sandwich the lock nut between the lock ring and the proximal end of the inner magnet assembly.

16. The mechanism of claim 15 wherein the bearing surface of the lock nut is frusto-conically shaped and the bearing surface of the lock ring is beveled for mateably receiving the frusto-conically shaped bearing surface of the lock nut.

17. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the rotor shaft also passing through two annular thrust washers that sandwich the distal bushing, the proximal bushing being received and supported within a proximal end of a canister that encloses the inner magnet assembly.

18. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the rotor shaft also passing through a proximal thrust washer sandwiched between a distal end of the inner magnet assembly and the distal bushing and also passing through a distal thrust washer sandwiched between the distal bushing and the rotor, the proximal bushing being received and supported within a proximal end of a canister that encloses the inner magnet assembly.

19. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the rotor shaft also passing through a proximal thrust washer sandwiched between a distal end of the inner magnet assembly and the distal bushing and also passing through a distal thrust washer sandwiched between the distal bushing and the rotor, the proximal bushing being received and supported within a proximal end of a canister that encloses the inner magnet assembly, the proximal end of the canister comprising a cup that encloses the proximal bushing and the proximal end of the rotor shaft, the proximal end of the canister being connected to a radial section that extends radially outwardly from the proximal end of the canister, the radial section of the canister being connected to an axial section of the canister that comprises a cylinder that extends axially around the inner magnet assembly and terminates at an open distal end that is connected to a casing, the casing comprising an axial passage in which the distal bushing is mateably received, the casing further defining a pump chamber in which the rotor and distal end of the rotor shaft are received, the axial passage of the casing extending from the open distal end of the canister to the pump chamber, the distal bushing, rotor shaft, distal thrust washer and rotor providing a seal and preventing fluid migration from the pump chamber in a proximal direction towards the axial passage of the casing.

20. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the rotor shaft also passing through a proximal thrust washer sandwiched between a distal end of the inner magnet assembly and the distal bushing and also passing through a distal thrust washer sandwiched between the distal bushing and the rotor, the proximal bushing being received and supported within a proximal end of a canister that encloses the inner magnet assembly, the proximal end of the canister comprising a cup that encloses the proximal bushing and the proximal end of the rotor shaft, the proximal end of the canister being connected to a radial section that extends radially outwardly from the proximal end of the canister, the radial section of the canister being connected to an axial section of the canister that comprises a cylinder that extends axially around the inner magnet assembly and terminates at an open distal end that is connected to a casing, the casing comprising an axial passage in which the distal bushing is mateably received, the casing further defining a pump chamber in which the rotor and distal end of the rotor shaft are received, the axial passage of the casing extending from the open distal end of the canister to the pump chamber, the distal bushing, rotor shaft, proximal thrust washer and inner magnet assembly providing a seal and inhibiting fluid migration from canister in a distal direction towards the axial passage of the casing.

21. A magnetic drive pump comprising:

a rotor shaft comprising a proximal end mateably received within a proximal bushing and a distal end connected to a rotor, the rotor shaft passing through and being connected to an inner magnet assembly disposed between the proximal bushing and the rotor, the rotor shaft further passing through a distal bushing disposed between the inner magnet assembly and the rotor, the rotor shaft further comprising a threaded surface disposed between a proximal end of the inner magnet assembly and the proximal bushing, the threaded surface of the rotor shaft being threadably connected to an annular locknut, the annular locknut comprising an annular bearing surface facing in a proximal direction towards the proximal end of the rotor shaft, the bearing surface of the annular locknut engaging a lock ring, the lock ring being connected to the proximal end of the inner magnet assembly by at least one fastener with the annular locknut sandwiched therebetween, the inner magnet assembly further comprising an axial key that is accommodated in an axial groove disposed in an outer surface of the rotor shaft disposed distally of the threaded surface of the rotor shaft, the proximal bushing being received and supported within a proximal end of a canister that encloses the inner magnet assembly.

22. The magnetic drive pump of claim 21 wherein the rotor shaft also passes through two annular thrust washers that sandwich the distal bushing.

23. The magnetic drive pump of claim 21 wherein the rotor shaft also passes through a proximal thrust washer sandwiched between a distal end of the inner magnet assembly and the distal bushing and the rotor shaft also passes through a distal thrust washer sandwiched between the distal bushing and the rotor.

24. The magnetic drive pump of claim 21 wherein proximal end of the canister comprises a cup that encloses the proximal bushing and the proximal end of the rotor shaft, the proximal end of the canister being connected to a radial section that extends radially outwardly from the proximal end of the canister, the radial section of the canister being connected to an axial section of the canister that comprises a cylinder that extends axially around the inner magnet assembly and terminates at an open distal end that is connected to a casing, the casing comprising an axial passage in which the distal bushing is mateably received, the casing further defining a pump chamber in which the rotor and distal end of the rotor shaft are received, the axial passage of the casing extending from the open distal end of the canister to the pump chamber.

25. The magnetic drive pump of claim 24 wherein the rotor shaft also passes through a proximal thrust washer sandwiched between a distal end of the inner magnet assembly and the distal bushing and the rotor shaft also passes through a distal thrust washer sandwiched between the distal bushing and the rotor, the distal bushing, rotor shaft, proximal thrust washer and inner magnet assembly providing a seal and inhibiting fluid migration from canister in a distal direction towards the axial passage of the casing.

26. The magnetic drive pump of claim 25 wherein the casing comprises an inlet passageway connected to a supply of coolant, the inlet passageway extending through the casing to a point disposed radially inside of the open distal end of the canister to connect an interior of the canister to the supply of coolant, the casing further comprising an outlet passageway connecting the interior of the canister to the supply of coolant.

* * * * *